US005588206A

United States Patent [19]

Maejima et al.

[11] Patent Number: 5,588,206

[45] Date of Patent: Dec. 31, 1996

[54] METHOD FOR INSERTING WIRE-EQUIPPED TERMINAL IN CONNECTOR HOUSING

[75] Inventors: Takamichi Maejima; Toshihiro Inoue; Hiroshi Hasegawa; Atsushi Nakano, all of Shizuoka, Japan

[73] Assignee: Yazaki Corporation, Tokyo, Japan

[21] Appl. No.: 344,665

[22] Filed: Nov. 22, 1994

[30] Foreign Application Priority Data

Nov. 29, 1993 [JP] Japan ..... 5-298102

[51] Int. Cl.[6] ..... H01R 43/00

[52] U.S. Cl. ..... 29/845; 29/748

[58] Field of Search ..... 29/845, 464, 468, 29/755, 747, 748, 33 M, 759

[56] References Cited

U.S. PATENT DOCUMENTS

| | | | |
|---|---|---|---|
| 4,936,011 | 6/1990 | Berry et al. | 29/845 |
| 4,967,740 | 11/1990 | Folk | 29/748 X |
| 4,970,777 | 11/1990 | Folk et al. | 29/748 |
| 5,208,977 | 5/1993 | Ricard | 29/33 M X |
| 5,309,633 | 5/1994 | Ricard | 29/33 M X |
| 5,315,756 | 5/1994 | Jurjevic et al. | 29/33 M X |
| 5,414,925 | 5/1995 | Nishide et al. | 29/748 |
| 5,457,875 | 10/1995 | Ohta et al. | 29/748 X |
| 5,485,660 | 1/1996 | Pittau | 29/748 X |

FOREIGN PATENT DOCUMENTS

| | | | |
|---|---|---|---|
| 3-66790 | 10/1991 | Japan . | |
| 5-54950 | 3/1993 | Japan | 29/33 M |

*Primary Examiner*—S. Thomas Hughes

*Attorney, Agent, or Firm*—Armstrong, Westerman, Hattori, McLeland & Naughton

[57] ABSTRACT

A pair of terminal grasping picks and a pair of wire clamping plates, which are provided in an insertion unit so that they can freely rise/fall and open/close, fall to grasp a first wire-equipped terminal clipped on a clip of a wire clamping rod; rise to separate the first wire-equipped terminal from the wire clip; advance toward the housing to insert the first wire-equipped terminal into the corresponding terminal container; and thereafter retreated and returned to an initial position, thereby successively inserting wire-equipped terminals. At any timing during the process in which the wire-equipped terminal is separated from the clip and thereafter the insertion unit is retreated and returned, either one of the wire clamping rod and the connector housing is moved in parallel to the other so that a second wire-equipped terminal or the clip is previously positioned oppositely to the a next terminal container of the housing.

5 Claims, 7 Drawing Sheets

METHOD FOR INSERTING WIRE-EQUIPPED TERMINAL IN CONNECTOR HOUSING

BACKGROUND OF THE INVENTION

1. Field of the Invention

The present invention relates to a method and an apparatus for inserting a wire-equipped terminal into a connector housing in the fabrication process of a wire harness.

2. Description of the Prior Art

FIGS. 7 and 8 show a method and apparatus for inserting a wire-equipped terminal into a connector housing according to the prior art (JP-A (Laid-Open) Hei 3-66790).

As seen from FIG. 7, on a rectangular stand plate 1, a plurality of housing receivers 2 are arranged at suitable intervals, and a connector housing 4 having a plurality of terminal containers 3 is set in each housing receiver 2.

A wire-clamping rod 5 is arranged oppositely to the stand plate 1. A large number of clips 6, each composed of a pair of clipping pieces *6a*, *6a*, are arranged in parallel at regular pitches. A terminal-crimped wire 7 is clipped in each clip 6.

A pair of terminal-grasping picks 9 and a pair of wire-clamping plates 10 are provided in an insertion unit 11 so that they can freely open/close and rise/fall, respectively. The insertion unit 11 is provided so that it can be freely brought into contact with, or separated from the connector housing 4 in movement along X-Y-Z axes and can rise/fall and shift horizontally with respect to the stand plate 1. Reference numeral 12 is a plate for fixing the wire-clamping rod 5.

The wire equipped terminals 8 can be inserted into the connector housing 4 as follows, in FIG. 8, the insertion unit 11 moves horizontally (X-axis movement) onto the first wire-equipped terminal indicated by symbol $\mathbf{8}_1$, falls and rises (Z-axis movement), grasps the terminal 81 and a wire $\mathbf{7}_1$ by the terminal-grasping pick 9 and the wire-clamping plate 10, advances towards the connector housing 4 (Y-axis movement) and inserts the terminal into a predetermined terminal container $\mathbf{3}_1$ and retreats.

The above prior art insertion method has the following drawbacks. In the step of inserting the wire-equipped terminal 8 by the insertion unit 11, the movement amount of the unit 11 is relatively less with respect to the Y and Z axes. On the other hand, with respect to the X axis, it is more. Specifically, for example, where the second wire-equipped terminal $\mathbf{8}_2$ is to be inserted, it takes a long time because the going up-and-down distance L where the insertion unit 11 goes to grasp the terminal and returns is relatively long. Because of a long loss time thus generated, the productivity cannot be enhanced.

SUMMARY OF THE INVENTION

An object of the present invention is to solve the above problem and to provide a method and apparatus for inserting a wire-equipped terminal into a connector housing which reduces the movement distance (X-axis) of an insertion unit from one terminal insertion to another terminal insertion, and shortens the time required for terminal insertion, thus enhancing the productivity.

In accordance with the present invention, at any time during the process of inserting the first wire-equipped terminal, either one of the wire-clamping rod and the connector housing is moved in parallel to the other so that the wire-equipped terminal to be inserted subsequently and the corresponding terminal container of the connector housing are previously positioned and fixed in such a manner that they are disposed opposite to each other. This realizes improvement of productivity because of great shortening of the time required for insertion.

The above and other objects and features of the present invention will be more apparent from the following description taken in conjunction with the accompanying drawings.

DESCRIPTION OF THE PREFERRED EMBODIMENTS

Embodiment 1

Figure 1:
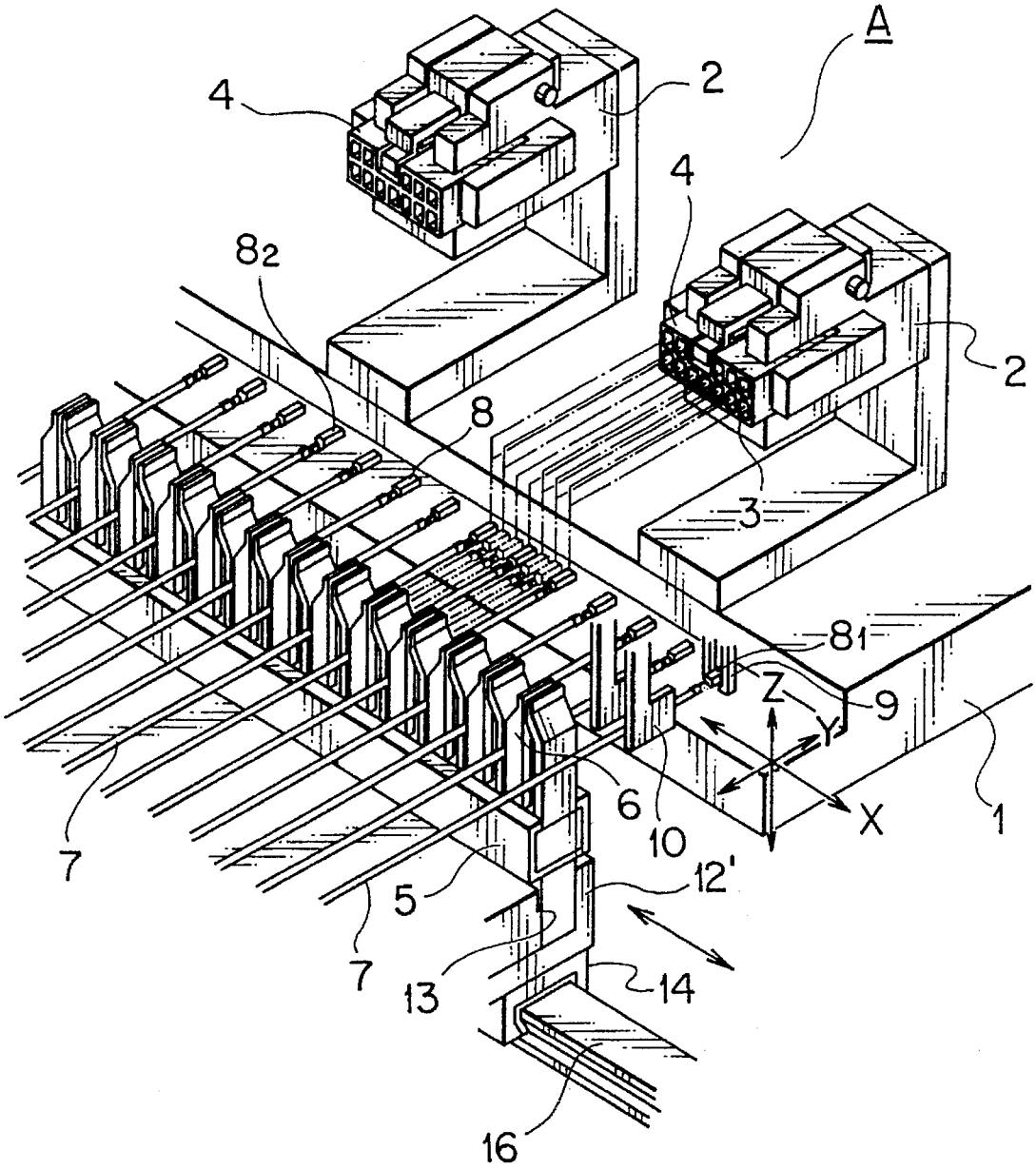
FIG. 1 is a perspective view of the main part showing one embodiment of the apparatus according to the present invention.

As seen from FIG. 1, a plurality of housing receivers 2 are arranged in a row on a stand plate 1 of a terminal insertion device A, and a connector housing 4 is set in each of the plurality of housing receivers. On a fixing plate 12' opposite to the stand plate 1, a wire clamping rod 5 is fixed. The wires 7 and end terminals 8 which are clipped in the respective clips 6 are successively inserted into terminal containers 3 by an insertion unit 11 (see FIG. 2) including a pair of terminal-grasping picks 9 and a pair of wire-clamping plates 10.

The wire equipped terminals can be inserted by repeating one cycle composed of the following four steps (a) to (d).

They are (a) a falling/grasping step in which the terminal-grasping picks 9 and the wire-clamping plates 10 fall in a state where they are open from above the wire clip 6 to grasp a terminal $\mathbf{8}_1$ and a wire 7; (b) a rising/waiting step in which the picks 9 and the plates 10 rise to separate the wire 7 from the wire clip 6 and stops; (c) advancing/inserting step in which they advance from the stopped position toward the housing 4 and, thereafter, open in the order of the picks 9 and plates 10 while inserting the terminal 8 into the terminal container 3; and (d) a retreating/returning step in which the picks 9 and the plates 10 retreat and return onto the wire clip 6.

Figure 7:
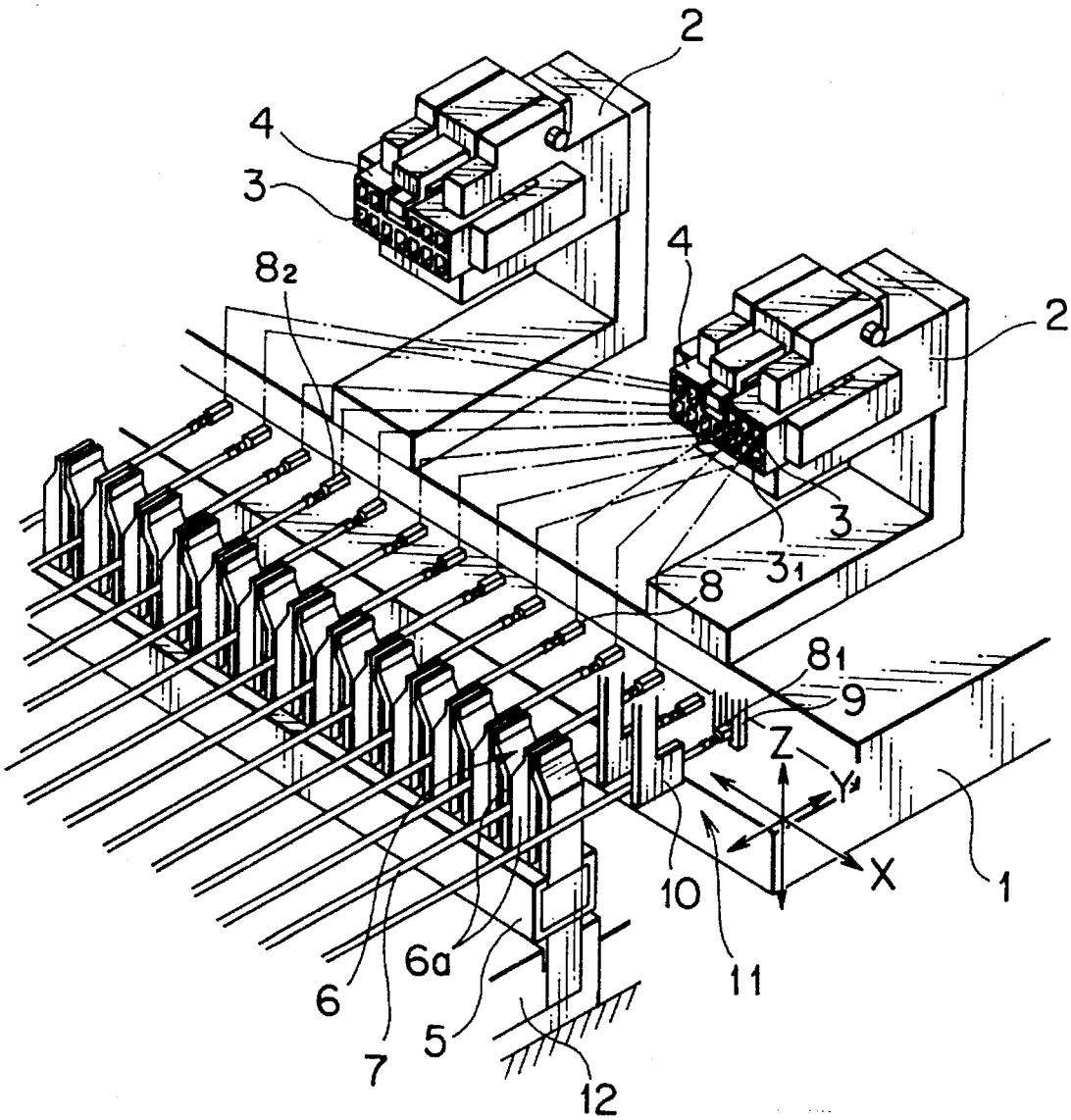
FIG. 7 PRIOR ART
FIG. 7 is a perspective view showing the main part of one example of the prior apparatus.
Figure 8:
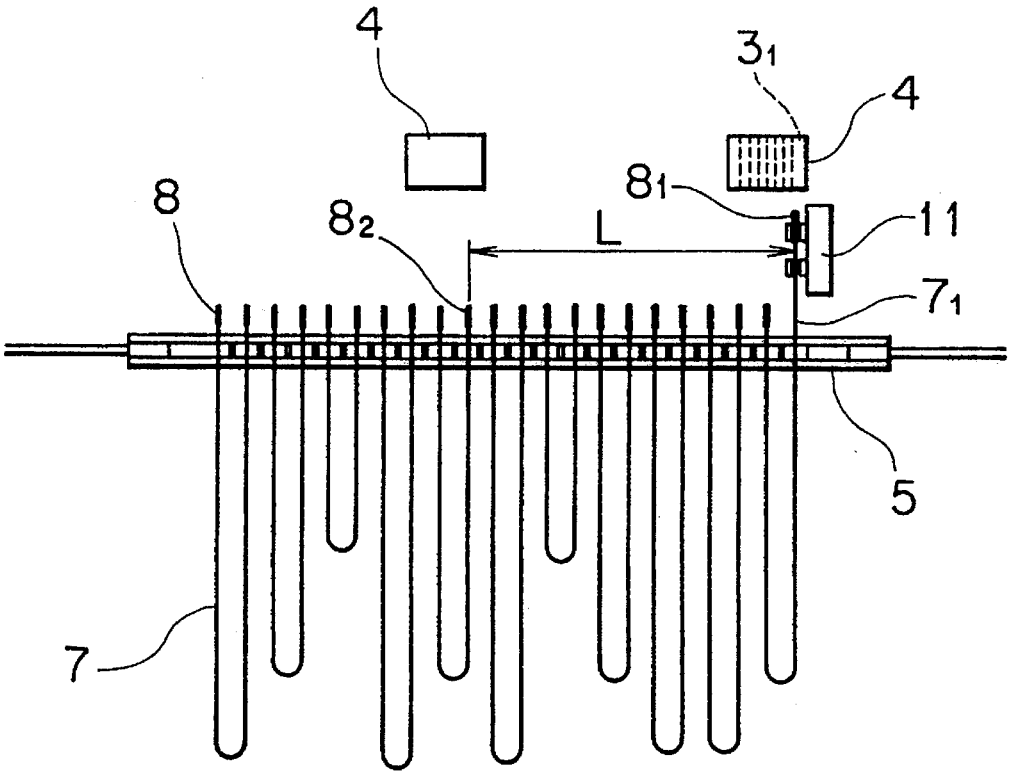
FIG. 8 PRIOR ART
FIG. 8 is a plan view of the prior art method.

Although the above steps are the same as in FIGS. 7 and 8 showing the prior art device, in the device according to the present invention, the fixing plate 12' on which the wire clamping rod 5 is fixed is provided so as to be movable in parallel to the stand plate 1. A specific wire-equipped terminal $\mathbf{8}_2$ in the wire clamp rod 5 can be moved to a position opposite to a desired connector housing 4 or terminal container 3 and can be positioned.

Figure 2A:
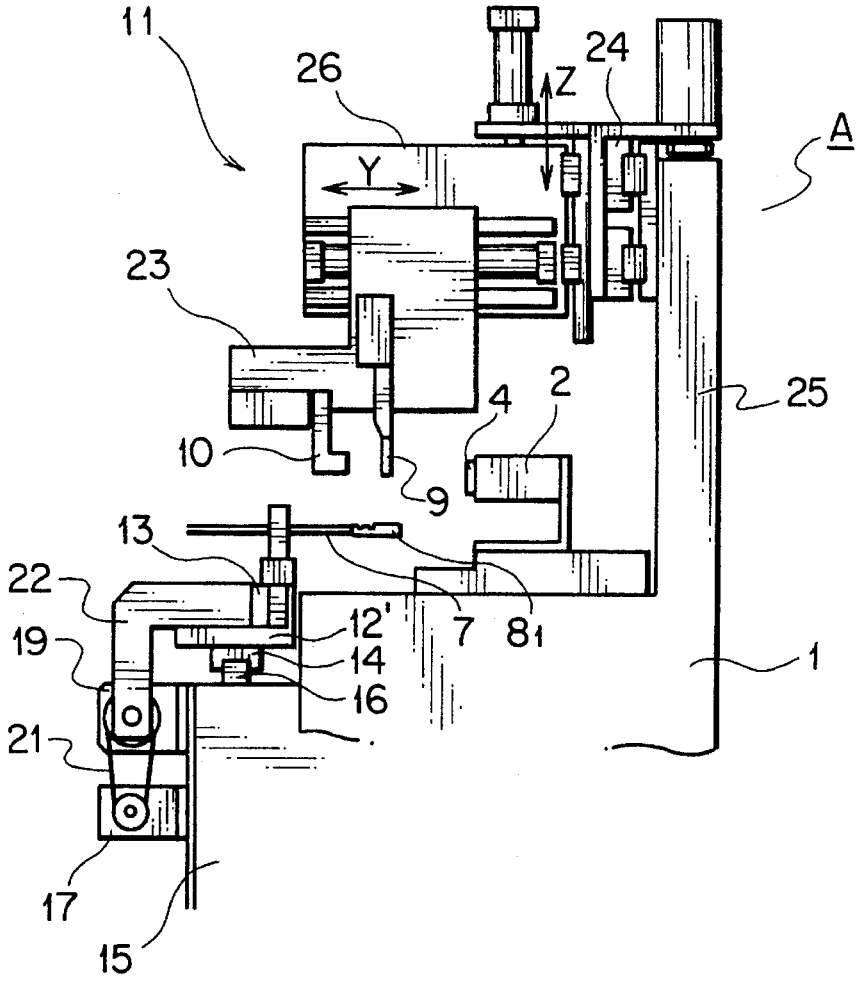
FIG. 2A is a side view of the apparatus shown in FIG. 1.
Figure 2B:
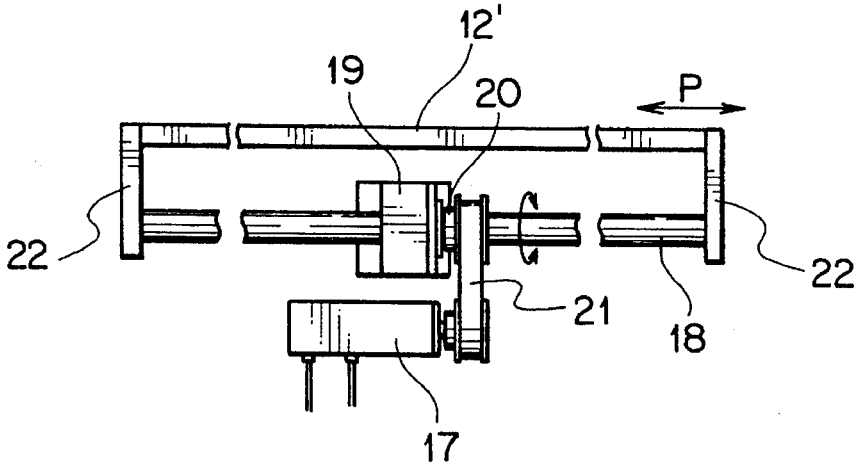
FIG. 2B is a front view of the driving portion in FIG. 2A.

FIG. 2A is a side view of the main part of the terminal insertion device A; and FIG. 2B is a front view of the driving portion in FIG. 2A.

The fixing plate 12' has a groove for holding the wire-clamping rod 5 at its one side edge, and has a grooved guiding member 14 protruding on its back surface. The guiding member 14 is slidably mounted on a guiding rail 16 on a stand 15. To the front face of the stand 15, a servo motor 17 and a nut portion 20 of the bearing member 19 of a ball screw 18 are fixed. The servo motor 17 and the nut portion 20 of the bearing member 19 are coupled with each other by a timing belt 21. Both ends of the ball screw 18 are pivoted on the lower ends of an L-shaped arms 22 and 23 fixed at both right and left ends of the fixing plate 12'. The fixing plate 12' is able to move back and forth in parallel to the stand 1 along an arrow P by the reversible rotation of the servo-motor 17.

The insertion unit 11 is so constituted that an attachment head 23 for the terminal grasping picks 9 and the wire-clamping plates 10 can move horizontally (Y axis) and vertically (Z-axis) by means of a moving plate 24. Reference numeral 26 denotes a head holder which serves as a spare plate for providing Y-Z axes so as to be separated from each other. Such a mechanism is disclosed in Japanese Patent Publn. He13-66790, and hence will not be explained here in detail.

Figure 3A:
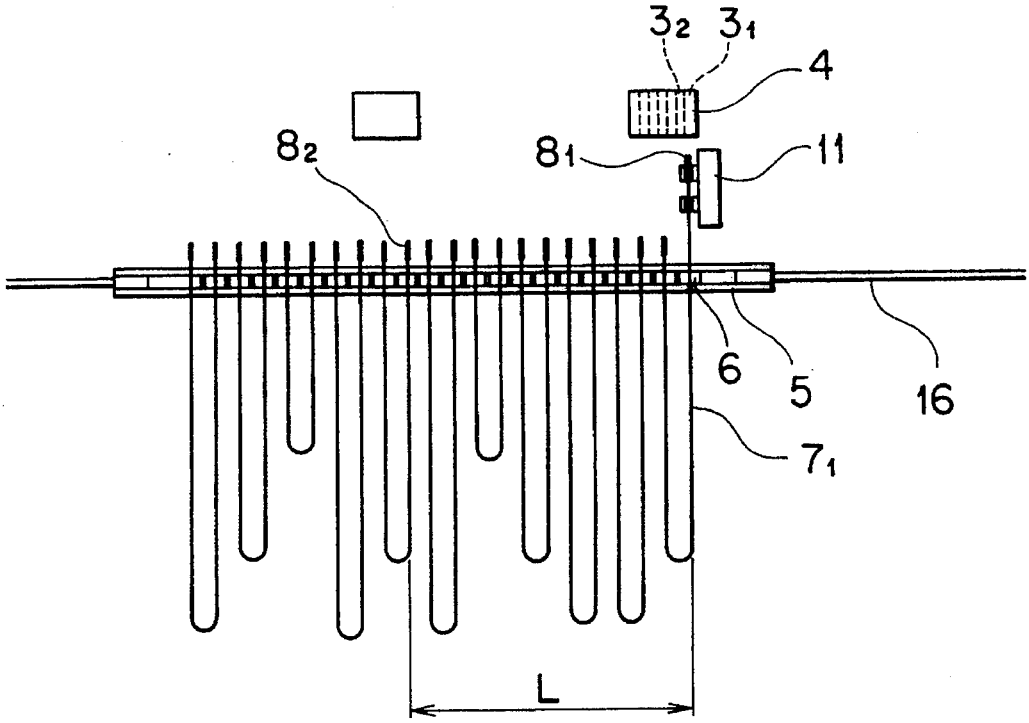
FIGS. 3A and 3B are views for explaining the method of inserting a terminal according to the present invention.

In the above arrangement, as shown in FIG. 3A, the first wire-equipped terminal $8_1$ in the wire-clamping rod 5 is inserted into the first terminal container 31 of the housing 4 by the insertion unit 11 as in the case of FIG. 8.

Figure 3B:
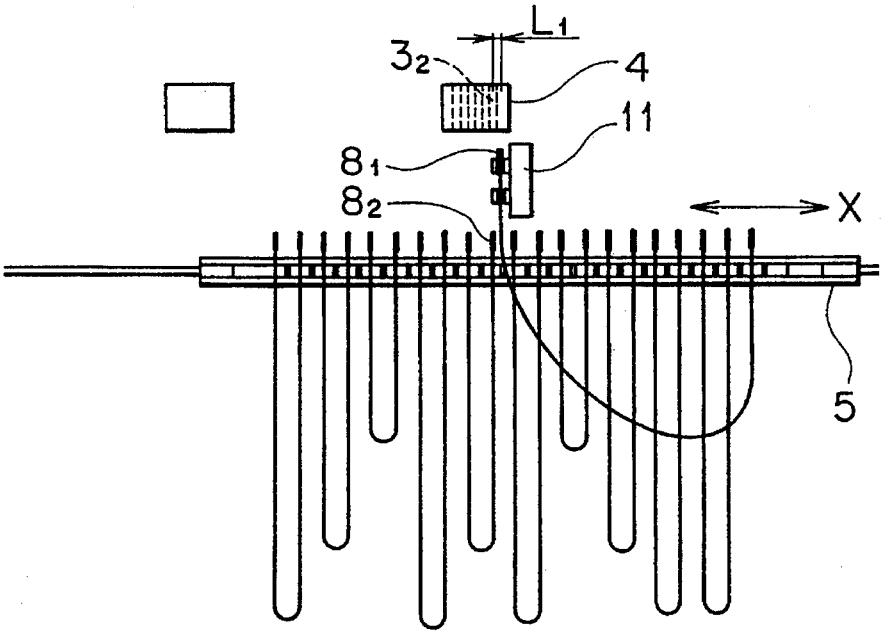

However, in the present invention, the terminal-grasping picks 9 and the wire-clamping plates 10 in the insertion unit 11 rise grasping the first wire-equipped terminal $8_1$ and, when the wire $7_1$ is separated from the clip 6, the wire-clamping rod 5 is moved as shown in FIG. 3B to position and fix the second wire-equipped terminal $8_2$ (or the second clip 6) at a position opposite to e.g. the adjacent terminal container $3_2$. Specifically, the fixing plate 12' is moved in parallel to the stand plate 1 along an arrow P by the servo motor 17 so that the wire-equipped terminal 82 is located in direct opposition to the terminal container $3_2$.

As a result, with respect to the movement of the insertion unit 11 in the X-axis direction, it has only to be moved by a small distance $L_1$ between the adjacent terminal containers $3_1$ and $3_2$. In addition, one-way movement has only to be performed. This permits remarkable time shortening as compared with the distance of 2 L (L represents the distance between the terminals $8_1$ and $8_2$) of the back-and-forth movement as shown in FIG. 8. Such a movement of the wire-clamping rod 5 may be carried out at any time during the process from the rising/waiting step (b) to the retreating/returning step (d).

In accordance with the present invention, the wire-equipped terminal is always previously moved to a position opposite to the connector housing or terminal container in which the terminal is to be subsequently inserted. For this reason, the insertion unit has only to be moved in one way from one terminal point to another terminal point, thus remarkably reducing the movement time in the X-direction.

Embodiment 2

The embodiment of FIGS. 1 to 3 is directed to the method of previously moving the wire-clamping rod 5 (wire-equipped terminal 8) in parallel to the connector housing 4. On the other hand, the embodiment shown in FIG. 4 is directed to a method which can control alignment between a wire-equipped terminal and a terminal container substantially by one axis mode.

Figure 4:
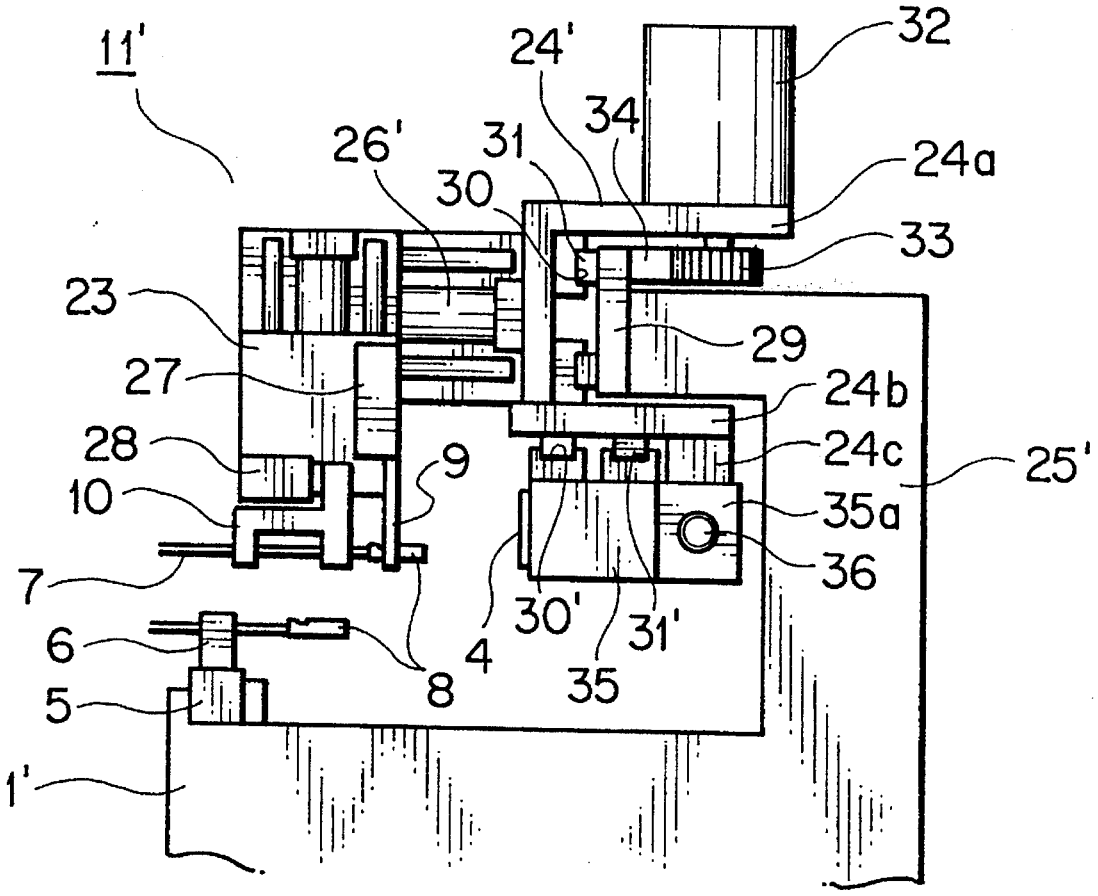
FIG. 4 is a side view of the apparatus showing another embodiment of the present invention.

In FIG. 4, a wire-clamping rod 5 is set removably on a stand plate 1'. Above it, an insertion unit 11' provided with a pair of terminal-grasping picks 9 and a pair of wire clamping plates 10 is provided. An attachment head 23 for the terminal-grasping picks 9 the wire-clamping plates 10 can freely rise/fail with respect to a head holder 26' (Z-axis). The head holder 26' can freely move to and from a movement plate 24' (Y-axis). The movement plate 24' is mounted on a guide plate 29 attached to a frame 25' so that it can slide by a guide groove 30 and a guide rail 31. The movement plate 24' moves in parallel to the wire-clamping rod 5' (X-axis) by a pinion 33 rotated by a servo motor 32 and a rack 34. Incidentally, reference numerals 27 and 28 are cylinders for opening or closing the terminal-grasping picks 9 and wire-clamping-plates 10, respectively.

As described above, as in the prior art, although the insertion unit 11' moves in the X-Y-Z axes for the wire-clamping rod 5, in this embodiment, the connector housing 4 moves integrally to, or individually from, the insertion unit 11' in the X axis direction.

The movement plate 24' is formed in a C shape composed of an upper top plate **24*a* and a lower bottom plate 24*b*. To the top plate 24*a*, the servo motor 32 is fixed, whereas to the bottom plate 24*b*, a housing receiver 35 is mounted slidably by the guide groove 30' and the guide rail 31'**.

Figure 5:
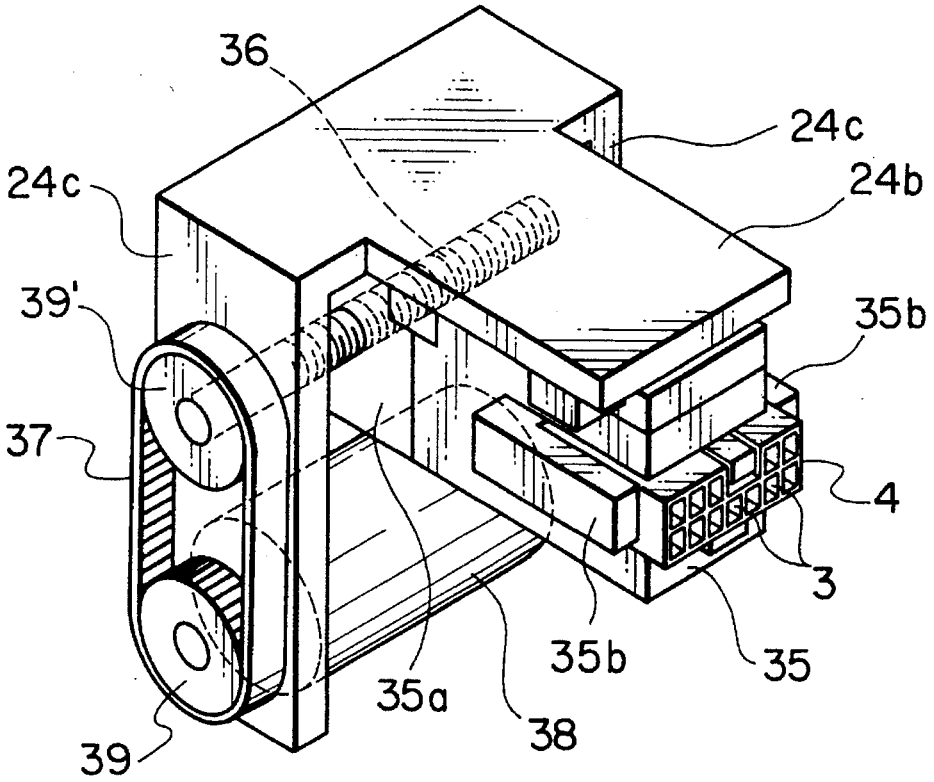
FIG. 5 is a perspective view of a connector receiver in FIG. 4.

To the stem portion **35*a* of the housing receiver 35, a ball screw 36 is screwed as shown in FIG. 5. The ball screw 36 is pivoted in its both ends in leg plate portions 24*c*, 24*c* protrusively formed on both ends of the lower bottom plate 24*b*, and its one end is coupled with the servo motor 38 fixed between the leg plate portions 24*c*, 24*c*. Reference numeral 39, 39 denote pulleys. The housing receiver 35 is provided with locking arms 35*b*, 35*b* on its both ends. The locking arms 35*b*, which can freely open or close, serve to lock the connector housing 4**.

In the insertion unit 11', the connector housing 4 is provided movably in the X-direction through the housing receiver 35.

Therefore, as in the previous embodiment, at any time during the process from the rising/waiting step (b) to the retreating/returning step (d) by the terminal-grasping picks 9 and the wire-clamping plates 10 in the insertion unit 11', the entire unit 11' is moved in the X-direction by driving the servo motor 32 so that it can be previously moved to the position of the second wire equipped terminal $8_2$ (see FIG. 3). When insertion of the first wire-equipped terminal $8_1$ is completed, i.e. when the wire-clamping plates 10 are opened successively to the terminal grasping picks 9, within the insertion unit 11', the housing receiver 35 is moved in the X direction by driving the servo motor 38 so that the second terminal container 3 can be aligned with the center line of the terminal grasping picks 9, 9. This permits the process of insertion of the second wire-equipped terminal $8_2$ to be started immediately.

This embodiment is similar to that of FIGS. 1 to 3 in that during the process in which one wire-equipped terminal is inserted into the connector housing 4 within the insertion unit 11', a subsequent wire-equipped terminal is previously positioned. Precise positioning of the terminal container $3_2$ into which the terminal $8_2$ is to be inserted can be done by driving the servo motor 38 within the insertion unit 11'.

Figure 6:
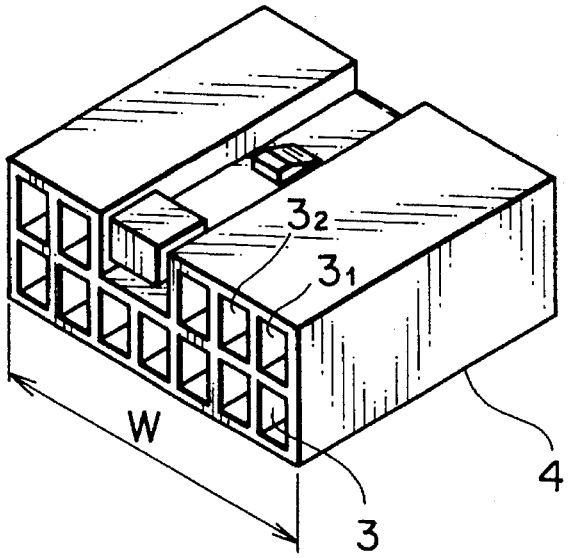
FIG. 6 is a respective view of the connector housing which is used to explain the present invention.

The movement distance of the connector housing 4 by the servo motor 38 is approximately equal to the width W of the connector housing 4 in its maximum, as shown in FIG. 6, so that it may be set for $W \pm \alpha$ a considering a trimming distance $\alpha$ for aligning it with the center line between the terminal grasping picks 9, 9. Positioning of the wire-equipped terminal 8 relative to the corresponding terminal container is controlled by the ball screw 36 rotated by the servo motor 38. Thus, it can be controlled precisely in a substantially one-axis mode.

We claim:

1. A method of inserting a series of wire-equipped terminals held in clips of a wire-clamping rod into containers of a connector housing by means of openable and closable terminal-grasping picks and wire-clamping plates of an insertion unit, comprising the steps of:

a) vertically moving said insertion unit from a first position to a second position with respect to said wire-clamping rod in a direction to locate said picks in grasping relation with respect to the terminal of a first wire-equipped terminal and said plates in clamping relation to the wire thereof;

b) activating said picks and said plates to grasp said terminal and clamp said wire;

c) vertically moving said insertion unit in a reverse direction to separate said first wire-equipped terminal from said the associated clip;

d) advancing said insertion unit with respect to said connector housing while sequentially opening said picks and said plates to insert said first wire-equipped terminal in a first predetermined container in said housing for receiving said first wire-equipped terminal;

e) returning said insertion unit to said first position;

f) at anytime during the period of performance of step c) to step e) with respect to said first wire-equipped terminal, establishing the position of a second wire-equipped terminal with respect to a second predetermined container in said connector housing for receiving said second wire-equipped terminal; and g) repeating steps a) through f) with respect to each of said second and succeeding wire-equipped terminals in said series.

2. A method of inserting a wire-equipped terminal into a connector housing according to claim 1, wherein said step of establishing the position of said second wire-equipped terminal with respect to a second predetermined container in said connector housing is conducted by moving said wire-clamping rod parallel to said housing so that a second clip for clipping said second wire-equipped terminal is positioned oppositely to the second predetermined container of the terminal housing.

3. A method of inserting a wire-equipped terminal into a connector housing according to claim 1, wherein said step of establishing the position of said second wire-equipped terminal with respect to a second predetermined container in said housing is conducted by moving said housing a required distance in parallel within the width of said housing to align said wire-clamping rod and a center line of a clip for clipping said second wire-equipped terminal with said second predetermined container.

4. A method of inserting a wire-equipped terminal into a connector housing according to claim 1, wherein said step of establishing the position of said second wire-equipped terminal with respect to a second predetermined container in said housing is conducted by simultaneously moving said insertion unit and the connector housing held in the insertion unit parallel to said wire-clamping rod to align said insertion unit and said connector housing with the second clip for clipping the second wire-equipped terminal.

5. A method of inserting a wire-equipped terminal into a connector housing according to claim 4, wherein said housing is moved a predetermined distance within the width of the housing parallel to said wire-clamping rod for aligning the second clip for clipping the second wire-equipped terminal with the second predetermined container.

* * * * *